United States Patent [19]

Shah

[11] Patent Number: 4,724,973

[45] Date of Patent: Feb. 16, 1988

[54] TAMPER EVIDENT CONTAINER SEAL

[75] Inventor: Hemant D. Shah, Voorhees, N.J.

[73] Assignee: SmithKline Beckman Corporation, Philadelphia, Pa.

[21] Appl. No.: 35,322

[22] Filed: Apr. 7, 1987

[51] Int. Cl.[4] ..... B65D 41/62

[52] U.S. Cl. ..... 215/246; 53/415; 53/442

[58] Field of Search ..... 53/415, 442; 215/246, 215/232, 230, 365

[56] References Cited

U.S. PATENT DOCUMENTS 2,361,464 10/1944 Edwards et al. ..... 215/246
2,954,139 9/1960 Owens ..... 215/246
4,544,073 10/1985 Willis ..... 215/246
4,633,648 1/1987 Yeung ..... 53/442 X

*Primary Examiner*—Donald F. Norton
*Attorney, Agent, or Firm*—Joseph A. Marlino; Stuart R. Suter; Alan D. Lourie

[57] ABSTRACT

A tamper evident seal for containers having a plastic shrink sleeve placed around the cap and neck and extending over the shoulder. A paper label is placed over a portion of the sleeve to prevent the sleeve from being removed intact. The sleeve has zigzag, saw-tooth perforations above and below a median line. The perforations are between the shoulder and cap of the container. When the cap is twisted and removed the plastic sleeve is randomly fragmented making it difficult, if not impossible to match in any attempt to reseal the container.

10 Claims, 10 Drawing Figures

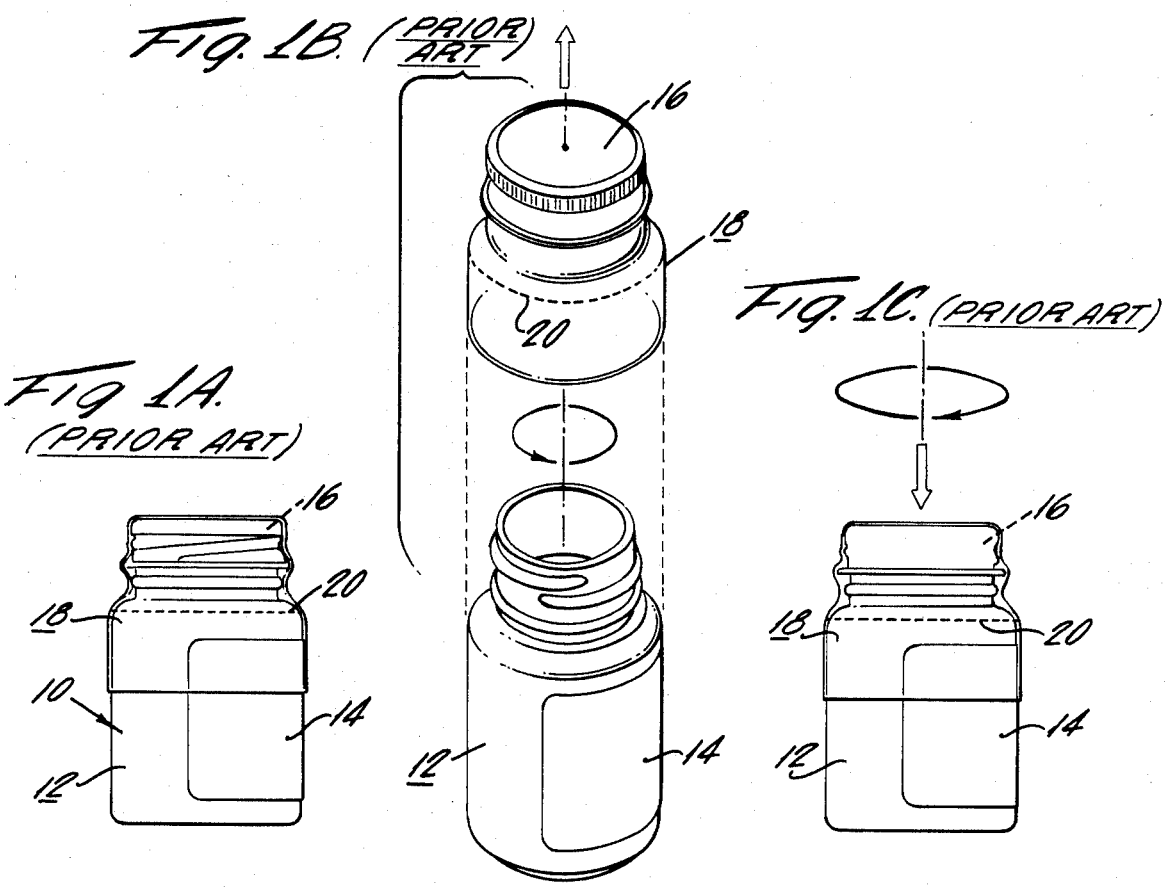
Fig. 1B. (PRIOR ART)
16
18
20
12
14
Fig. 1C. (PRIOR ART)
16
18
20
12
14
Fig. 1A. (PRIOR ART)
16
20
18
10
14
12
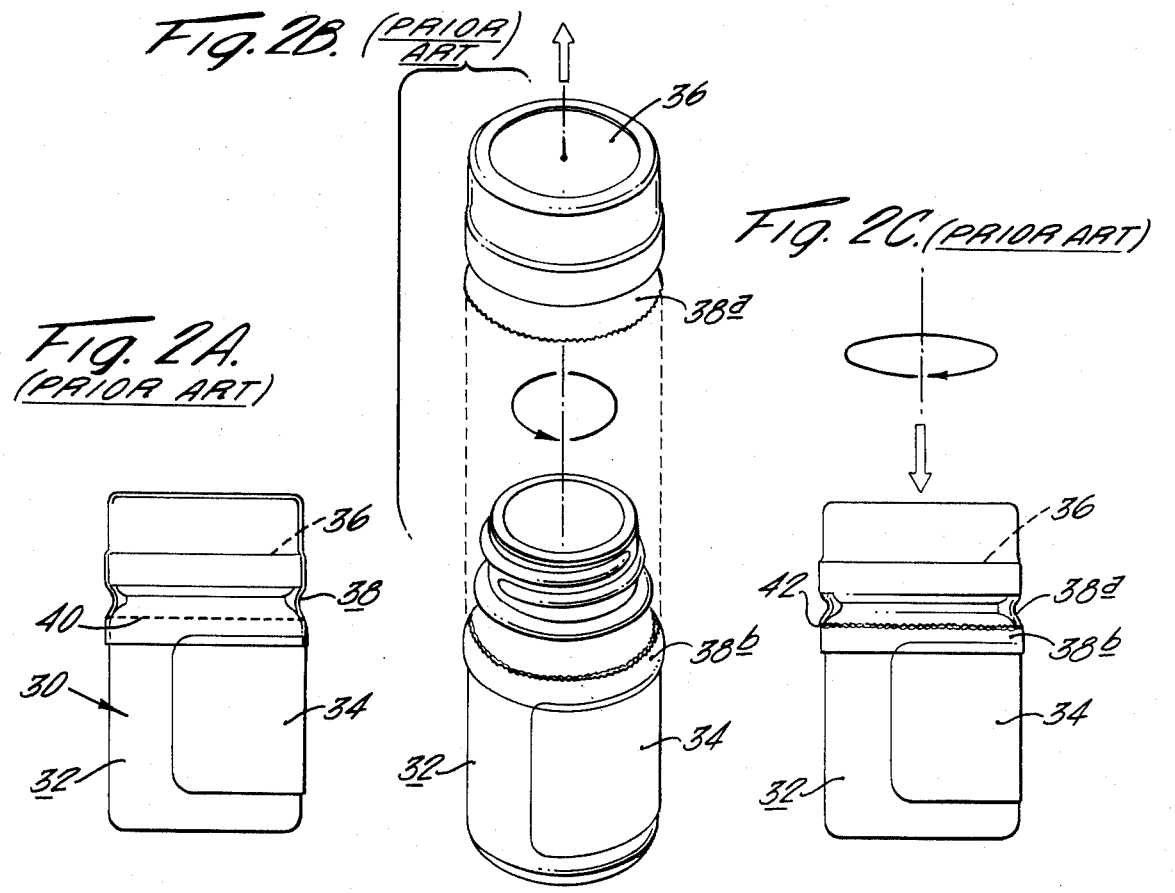
Fig. 2B. (PRIOR ART)
36
38a
38b
32
34
Fig. 2C. (PRIOR ART)
36
42
38a
38b
34
32
Fig. 2A. (PRIOR ART)
36
38
40
30
34
32

TAMPER EVIDENT CONTAINER SEAL

BACKGROUND OF THE INVENTION

This invention relates to tamper evident seals for containers which hold capsules, pills and other products which can be contaminated or tampered with. The recent incidences of contamination of drugs in capsules and other consumer products has created a need for tamper evident packaging for these and other various dosage forms of medicaments and other products for ingestion by humans.

One of the conventional methods of sealing containers for capsules, pills, liquids and the like usually consist of a plastic shrink sleeve around the cap and neck of the container. The disadvantage of this is that the sleeve comes off in one piece with twisting and removal of the cap. The sleeve can then be returned to its original position by carefully placing the cap on the container. Note prior art FIGS. 1A, B and C. A variation of this conventional seal is one that has a circumferential, intermittently perforated line on a heat shrinkable plastic sleeve just below the cap. Removal of the cap results in a clean break of the plastic along the perforated seam. This linear perforated pattern is easily matchable when the cap is replaced. Note prior art FIGS. 2A, B and C.

It is readily apparent that the above conventional sleeves or bands can be either easily removed from the package intact or severed along a seam and replaced without any evidence of tampering.

An object of this invention is to provide a tamper evident seal for the containers of such products which will clearly indicate if the container has been tampered with.

A still further and important object of this invention is to provide a tamper evident seal which provides a high degree of security against efforts to reseal the package once it has been opened.

SUMMARY OF THE INVENTION

Briefly, the invention provides a tamper evident seal for containers by placing a plastic shrink sleeve around the cap and neck and extending over and below the shoulder. A paper label is placed over a portion of the sleeve and container securing the sleeve in place and thus preventing the sleeve from being removed intact. The sleeve has a pattern of zigzag, saw tooth perforations extending above and below a median line. The perforations are between the shoulder and cap of the container. When the cap is twisted and removed the plastic sleeve is randomly fragmented making it difficult to match in any attempt to reseal the container. This provides a double tamper evident seal, i.e., since the sleeve is secured under the paper label it would be difficult to remove intact and the zigzag perforations which result in random fragmentation of the sleeve makes it impossible to reseal the container in its original configuration.

A detailed description and better understanding of this invention can be had by referring to the accompanying drawings which show a preferred embodiment of the present invention.

FIGS. 1A–1C demonstrate sequential cap opening and closing views of a conventional (prior art) container illustrating one of the more serious defects, i.e., intact removal of the shrink sleeve.

FIGS. 2A–2C demonstrate sequential cap opening and closing views of a further prior art container illustrating another serious defect, perforated pattern is easily matchable when cap is replaced (FIG. 2C).

Figure 4:
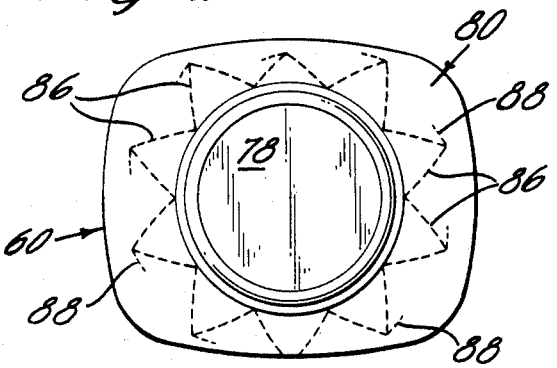
FIG. 4 is a plan view of the tamper evident container shown in FIG. 3 showing additional details of construction on a sealed container.

Referring to prior art FIGS. 1A–1C as shown in a sealed container 10 has a shrink sleeve 18 having a horizontally, circumferentially score line 20 secured to screw cap 16 and the container. The sleeve overlies paper label 14. When the screw cap is twisted and removed sleeve 18 slips off the container intact, FIG. 1B. When the cap is returned to the container the sleeve assumes its original position, FIG. 1C. There is no evidence that any tampering has occurred.

As shown in prior art FIGS. 2A–2C a sealed container 30 has a shrink sleeve 38 around Cap 36 and the container. The shrink sleeve has a horizontally, circumferentially scored line 40 and overlies a portion of paper label 34. Twisting and removal of the cap results in a clean break of the sleeve along the scored line 40. A portion of the sleeve, **38*a* is removed with the cap above the score line 40 and a portion of the sleeve 38*b* adheres to the container below the score line. The pattern is easily matched 42** when the cap is replaced as shown in FIG. 2C and tamper evidence is not visible.

Figure 5:
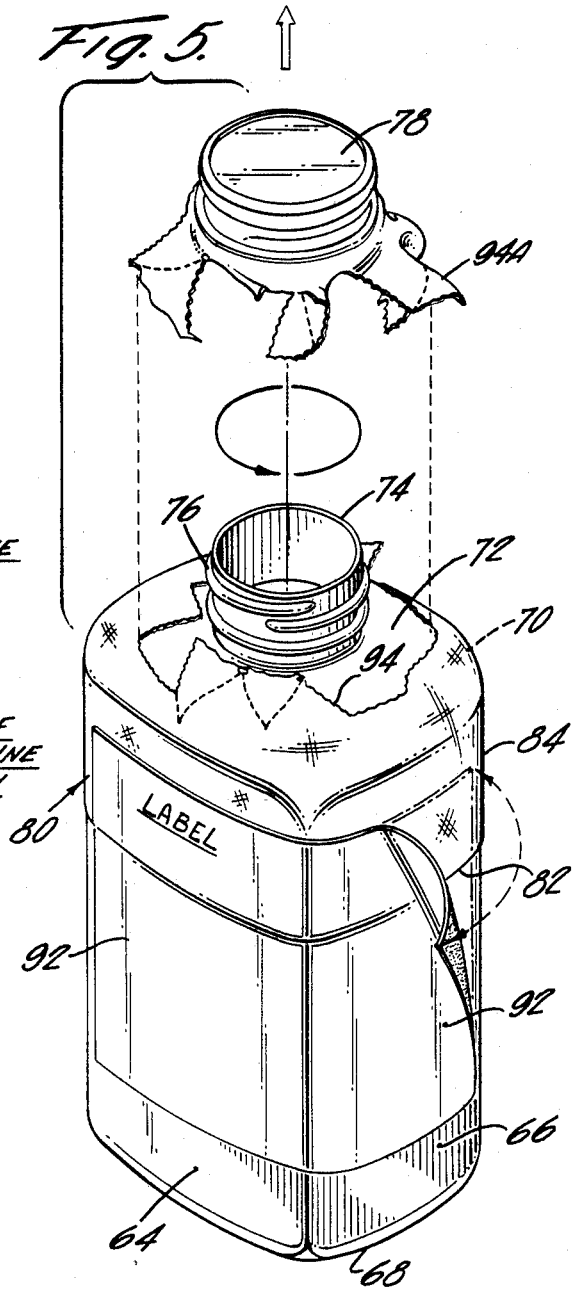
FIG. 5 is an exploded perspective view of the tamper evident container shown in FIGS. 3 and 4 having been opened by turning the screw cap and randomly producing an irrestorable tearing and fragmenting of the plastic shrink sleeve.
Figure 3:
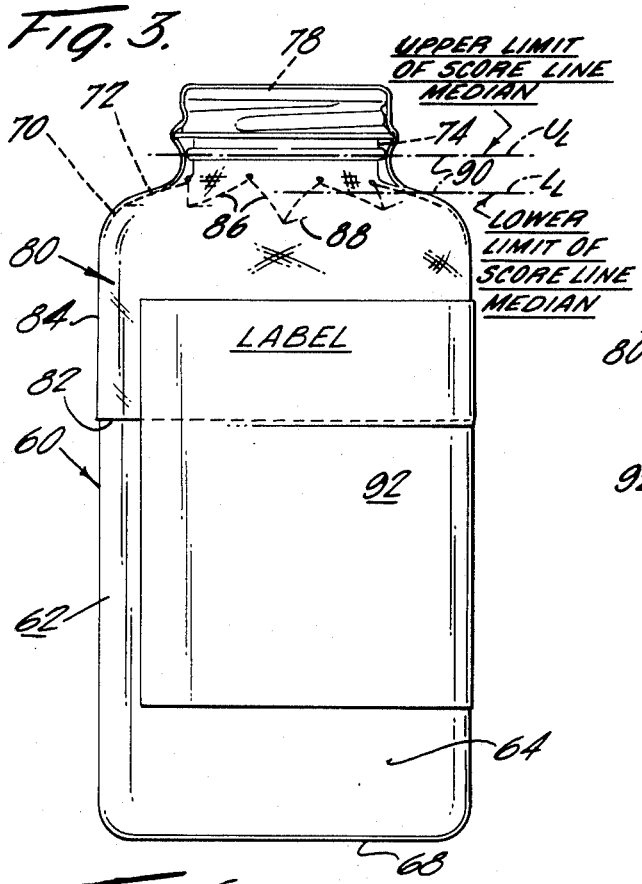
FIG. 3 is a side elevational view of a tamper evident container of this invention showing certain details of construction on a sealed container.

FIGS. 3–6 represent the applicant's invention. A container 62 has side walls 64 and end walls 66 with an integral closed bottom 68. The container has a plastic heat shrunk tamper evident sleeve 80 extending from the upper terminal surface of the cap 78 downwardly in gripping engagement with the cap contours, drawn inwardly about the threaded neck portion 74 and 76 and in gripping engagement with the top wall 72, shoulder 70 and side and end walls 64 and 66 respectively. The sleeve terminates in a lower terminal edge 82 having a skirt length 84 of about one third of the container height as measured from the shoulder 70 to container bottom 68. A label 92 is adhesively applied in such a manner that a portion of the label 92 overlies the skirt 84 of the tamper evident sleeve 80 and is wrapped around a portion of the sealed container's circumference 60. The lower portion of the label 92 is adhesively bonded to the container 62 as shown in FIGS. 3 and 5.

As shown in FIG. 5 when the container is opened by the twisting of cap 78 a random tearing 94 is provided in the tamper evident sleeve. If the cap and its associated fragment of sleeve 94A is replaced on the container the irregular tearing can not be rematched due to the distortions of the relaxed plastic material.

Figure 6:
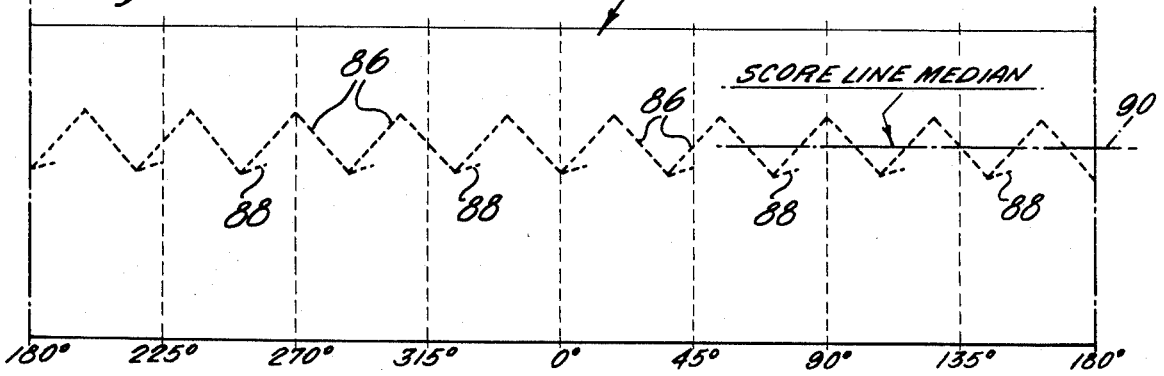
FIG. 6 is a development of a normally tubular plastic heat shrinkable material illustrating a geometric pattern of the scored lines.

FIG. 6 shows the development of a normally tubular sleeve prior to being heat shrunk about the upper portion of container 62. The development shows a horizontally extending pattern of joined adjacent triangles 86 formed by intermittent scoring of the plastic material that comprises the tamper evident sleeve. In addition, extending along the lower terminal apex of each triangle and directed to the right are short slightly positively sloped perforated extensions 88. These small perforated extensions provide a random tear path which fragments the shrink sleeve when the sealed container is opened as shown in FIG. 5. A score line median 90 is shown in FIGS. 6 and 3 only as an aid in understanding the invention and is not a physical part of the sleeve.

The plastic shrinkable sleeve may be applied and shrunk at production line speeds by any shrink banding machine well known to the art. To assemble the finished container a flat, tubular heat shrinkable film is fed into the machine in a continuous manner from a roll. The tube is cut to the appropriate size, approximately ⅓ of the container height as measured from the shoulder to the container bottom. The sleeve is die-cut with the perforated pattern and mechanically opened and placed on the container covering the closure and approximately ⅓ of the container height. The container is passed through a heat tunnel to shrink the sleeve. A label is placed, preferably adhesively applied, over a portion of the sleeve and container to cover and secure part of the sleeve in place. The pre-cut and pre-perforated sleeve can also be manually applied onto the container and passed through the heat tunnel to shrink the sleeve.

The tamper evident shrink sleeve of this invention therefore has two very important advantages. First, because the label overlies the sleeve, intact removal of the sleeve is not possible without evidence of the label being torn. A second advantage is that due to the zigzag, saw-tooth pattern of the perforated seams, a random tearing of the sleeve occurs which can not be rematched in an attempt to reseal the container.

Advantageously the tamper evident sleeve is of a transparent plastic heat shrinkable material such as, for example, a polyvinyl chloride film. Other materials such as Mylar may be used for the sleeve.

The above embodiments are illustrative and are not intended to be limiting. For example, container 62 could be round, oval or various other shapes.

What is claimed is:

1. In a tamper evident container having a body portion with a generally cylindrical neck defining an opening into the container, threads formed in the outer peripheral surface of the neck, a screw cap covering said opening, an outwardly projecting shoulder formed below the neck, the improvement comprising; a shrink sleeve having a zigzag perforated pattern, said sleeve shrunk around the cap and neck and extending over the shoulder and downwardly around a portion of the body and a label overlying a portion of the sleeve and container securing said sleeve in place whereby when the cap is twisted and removed the sleeve is randomly fragmented and prevented from being removed intact.

2. The container of claim 1 wherein the zigzag perforated pattern of the shrink sleeve is between the shoulder and the cap.

3. The container of claim 1 wherein the shrink sleeve has a skirt length of about one third of the container height as measured from the shoulder to the container bottom.

4. The container of claim 1 wherein the shrink sleeve is polyvinyl chloride.

5. The container of claim 1 wherein said label is adhesively secured and overlies the lower terminal edge of the shrink sleeve and a portion of the container.

6. A tamper evident sealing device for a container having removable closure means comprising a plastic shrink sleeve having a zigzag perforated pattern providing a random tear path whereby the shrink sleeve is fragmented when the container is opened.

7. In a tamper evident container having a body portion with a generally cylindrical neck defining an opening into the container, threads formed in the outer peripheral surface of the neck, a screw cap covering said opening, an outwardly projecting shoulder formed below the neck, the improvement comprising a shrink sleeve shrunk around the cap and neck said sleeve extending over the shoulder and downwardly around a portion of the body and a label overlying a portion of the sleeve and container securing said sleeve in place whereby said sleeve is prevented from being removed intact.

8. The container of claim 7 wherein the shrink sleeve is a polyvinyl chloride film.

9. The container of claim 7 wherein said label is adhesively secured and overlies the lower terminal edge of the shrink sleeve and a portion of the container.

10. A method of producing a tamper evident container comprising the steps of:

(a) continuously feeding a flat, tubular film into a shrink banding machine;
(b) die cutting a zigzag perforated pattern on said film;
(c) opening the flat film;
(d) placing the film over the container,
(e) passing the container through a heat tunnel to shrink the film; and
(f) placing a label over a portion of the film and container to secure the film in place.

* * * * *